United States Patent [19]

Matsui et al.

[11] Patent Number: 4,485,378

[45] Date of Patent: Nov. 27, 1984

[54] DISPLAY CONTROL APPARATUS

[75] Inventors: Kenji Matsui, Nagaokakyo; Masakatu Watanabe, Kyoto, both of Japan

[73] Assignee: Omron Tateisi Electronics Co., Kyoto, Japan

[21] Appl. No.: 329,506

[22] Filed: Dec. 10, 1981

[30] Foreign Application Priority Data

Dec. 11, 1980 [JP] Japan ..... 55-175391

[51] Int. Cl.[3] ..... G09G 1/02

[52] U.S. Cl. ..... 340/750; 340/798

[58] Field of Search ..... 340/750

[56] References Cited

U.S. PATENT DOCUMENTS 4,158,838 6/1979 Pruznick et al. ..... 340/750

*Primary Examiner*—David L. Trafton

*Attorney, Agent, or Firm*—Schwartz, Jeffery, Schwaab, Mack, Blumenthal & Koch

[57] ABSTRACT

A display comprises a relatively large plurality of picture elements in each of the vertical and horizontal directions, with which characters are displayed with a relatively less plurality of picture elements in each of the vertical and horizontal directions. In order to store the data to be displayed with the above described display, a refresh memory is employed. The refresh memory is used such that the respective areas thereof storing portions of the character are addressed in synchronism with the period of a character clock, whereby the character data to be displayed is read out therefrom. Each portion of the character data as read out from the refresh memory is latched in a latch circuit during the character clock period and is kept supplied to the display. The refresh memory serves to renew portions of the character at an arbitrary timing during the display period by the display or during the blanking period where display is not made by the display.

10 Claims, 9 Drawing Figures

READ CONTROL CIRCUIT
3
DT1, DT2
CLK
RAD
WAD
MULTIPLEXER
2
AD
REFRESH MEMORY
1
RD
WD
LINE BUFFER
6
WD
MPSE
LATCH ENABLING CIRCUIT
8
LEP
LATCH CIRCUIT
7
LD
VIDEO SIGNAL GENERATOR
9
DISPLAY
10
DISPLAY DATA RENEWAL CONTROL CIRCUIT
4
RMSE
ACCESS CONTROL CIRCUIT
5

DISPLAY CONTROL APPARATUS

BACKGROUND OF THE INVENTION

1. Field of the Invention

The present invention relates to a display control apparatus. More specifically, the present invention relates to an improvement in a display control apparatus for controlling a display operation of a display which comprises a plurality of picture elements such as a dot display, a CRT display, and the like.

2. Description of the Prior Art

A display has been employed most typically in various types of electronic equipment in order to display information. Typical examples of such displays which are well-known are a dot display, a CRT display and the like. Any of such displays has a screen formed with a group of a plurality of minimum display units, i.e. picture elements or dots, whereby desired characters are displayed as a combination of an enabled or disabled state of each of the picture elements. A conventional display control apparatus for controlling a display operation of such display comprises a memory for receiving display data from an external processing unit, such as a central processing unit of a microprocessor, thereby to store the same, and functions to read the stored data in the memory as a function of a synchronizing signal. The respective picture elements in the display are selectively driven for display as a function of the read data. Meanwhile, renewal of the display data, i.e. renewal of the stored data in the memory must be performed while a display operation by the display is interrupted in the course thereof and hence a flickering phenomenon was caused thereby. In order to prevent the same, a conventional display control apparatus was adapted to renew the data in the memory during a blanking period of the display. However, such a display control apparatus necessitates a detecting circuit for detecting a blanking period from the synchronizing signal and hence involves a disadvantage that the circuit configuration becomes complicated and expensive. Furthermore, since renewal of the display data stored in the memory is limited only to the above described display blanking period according to a conventional display control apparatus, it becomes impossible to renew the display data during a period shorter than a period required for displaying all of one frame of the display and hence another disadvantage is also involved that such a conventional display control apparatus can not be employed in a display requiring a change of the display data during a relatively short period.

The above described display is utilized in some cases such that fixed data is displayed in a certain region of the display screen and changeable data is displayed in other regions of the display screen. The fixed data could be units of current time information, such as day, hour, minute, framing of the screen, headline data of various kinds of data, lining in graphs and other fixed display patterns. On the other hand, the changeable data could be data of the current time information, various kinds of numerals or symbols or characters, and lines of graphs and the like.

Meanwhile, a conventional display control apparatus for displaying both the fixed data and the changeable data in a display was structured such that a display data memory is provided which has a plurality of bits corresponding to a plurality of picture elements on the screen of the display and display data entered from an external processing unit such as a microprocessor is stored in the display data memory and the data in the memory is sequentially read out by a read control circuit in synchronism with addressing of the display coordinate positions of the display, whereby the data is displayed on the display. However, since the fixed data must be displayed at a predetermined position on the screen, the data need be read from the memory and the same need be displayed at a predetermined period. On the other hand, since the changeable data is stored in the memory and is read out therefrom, renewal of the data in the memory is required. Necessity of storing such changeable data in a renewing manner is different depending on the kinds of the data to be displayed but such necessity arises frequently and therefore frequent renewal of the data in the memory necessitates a considerable processing time period. However, the reading out of the changeable data is performed during a time period after completion of renewal storing until reading of the fixed data. Therefore, the reading time period of the changeable data changes depending on the amount of the changeable data and in an extreme case it could happen that the reading time period of the changeable data extends to the reading time period of the fixed data. Therefore, disadvantages were involved that the changeable data and the fixed data could be displayed in an overlapped manner and a flickering phenomenon is liable to be caused.

SUMMARY OF THE INVENTION

A display control apparatus in accordance with the present invention comprises means for generating a signal having a period associated with a time period required in displaying a minimum unit such as a portion of a character in a display, wherein it is determined whether an access request is available for renewal of the display data at each minimum read period and, if an access request is available, the display data is renewed in the minimum read period and the above described minimum unit is displayed in a time period other than the above described minimum read period, whereby display control is performed in a time sharing manner. According to the present invention, the display data can be renewed during both a display period of the display and a blanking period when no display is made in the display and as a result a flickering phenomenon of the display can be prevented.

In a preferred embodiment of the present invention, storage means for storing display data comprises a fixed data storing region for storing fixed data and a changeable data storing region for storing changeable data wherein the data can be renewed at any timing. When a signal is generated for reading the stored data in the fixed storing region, the fixed data is read out by use of an address designating function of writing means for renewing the stored data in the changeable data storing region. As a result, the fixed data is always displayed in a specified displaying region of the display and a structure for displaying the fixed data can be simplified.

Accordingly, a principal object of the present invention is to provide a display control apparatus wherein the display data can be renewed or changed at any timing during either a display period of the display or a blanking period when no display is made, whereby a flickering phenomenon of the display can be prevented.

Another object of the present invention is to provide a display control apparatus that can dispense with such a particular circuit as a circuit for detecting a blanking period for renewing or changing the data, whereby a circuit configuration can be implemented with simplicity and with inexpensive cost.

A further object of the present invention is to provide a display control apparatus, wherein the fixed data and the changeable data can be displayed with a simple structure without necessitating renewal of such fixed data, whereby a time period for storing the changeable data in storage means in a renewing manner can be shortened, thereby to prevent a flickering phenomenon in the display.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
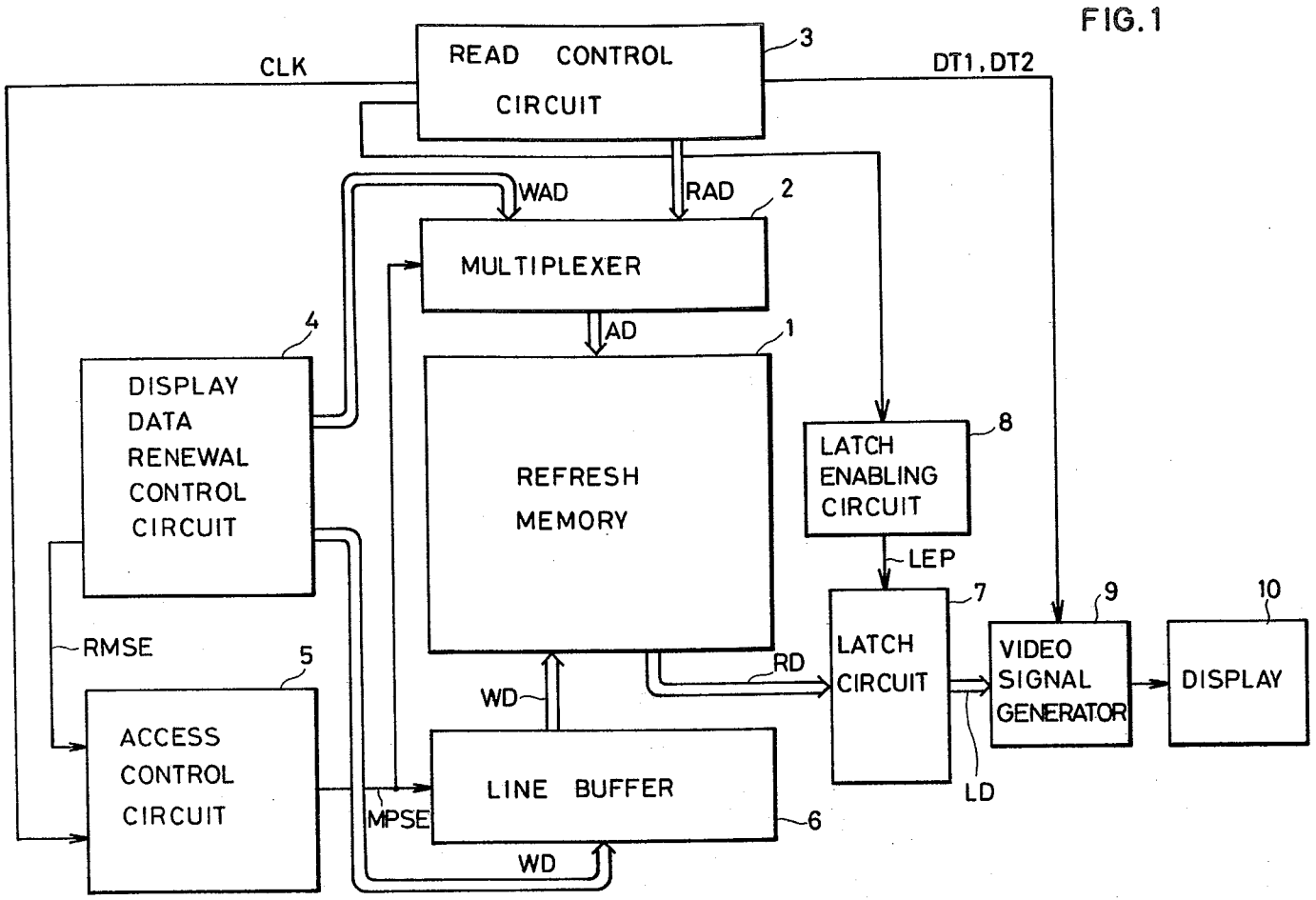
FIG. 1 is a block diagram showing an outline of one embodiment of the present invention.

FIG. 1 is a block diagram of a display control apparatus in accordance with one embodiment of the present invention. A refresh memory 1 employed as one example of a display data storage means comprises a storage capacity capable of storing data of one picture frame to be displayed by a display 10. The refresh memory 1 is supplied with address data AD from a multiplexer 2. The multiplexer 2 is supplied with read address data RAD from a read control circuit 3 and write address data WAD from a display data renewal control circuit 4. The read control circuit 3 generates a minimum read clock signal for reading display data of a minimum unit to be described subsequently, referred to hereinafter as character clock CLK, and also periodically generates read address data RAD in synchronism with the character clock CLK. By the minimum unit is meant herein a minimum unit data stored in the refresh memory 1 for displaying a desired kind of character such as a portion or all of a character to be displayed. For example, in the case where the display 10 comprises a CRT display including a relatively large plurality (say 256×256) of picture elements or dots arranged in columns and rows, the minimum unit display data corresponds to one row (corresponding to 8 dots) in the horizontal scanning direction of an electronic beam with respect to a relatively small plurality (say 8×8) of picture elements constituting one character. Furthermore, the read control circuit 3 provides a synchronizing signal in synchronism with the reading of the refresh memory 1 to a video signal generating circuit 9. The synchronizing signal comprises a first display timing signal DT1 and a second display timing signal DT2 (shown in FIG. 5B) to be described subsequently, for designating a display timing of the display 10. The display data renewal control circuit 4 comprises a microprocessor, for example, including a circuit performing an arithmetic operation and a memory for storing the data for a number of picture frames each to be displayed in the display 10. The display data renewal control circuit 4 generates an access request signal RMSE of the high level, write data WD and write address data WAD when renewal of the data in the refresh memory 1 is required.

The above described character clock CLK and access request signal RMSE are applied to an access control circuit 5. The access control circuit 5 determines whether the access request signal RMSE is applied at each period of the character clock CLK (say at the fall of the clock CLK) and provides an access switch signal MPSE when the access request signal RMSE is available. The access switch signal MPSE is applied to the multiplexer 2 as a signal for enabling selection of a write mode and is also applied to a line buffer 6. The line buffer 6 comprises a storing capacity corresponding in terms of bits to the picture element number of one line in the same horizontal direction as the scanning direction of the display 10 and stores the data of one line as one unit of write data and provides the same to the refresh memory 1. The read data RD of the refresh memory 1 is applied to a latch circuit 7. The latch circuit 7 is supplied with a latch enabling pulse LEP from a latch enabling circuit 8. The latch enabling circuit 8 is adapted to generate the latch enabling pulse LEP shortly before the start of the following period of the character clock CLK at each period of the character clock CLK. The data LD latched in the latch circuit 7 is supplied to a video signal generating circuit 9. The video signal generating circuit 9 comprises a character generator, for example, and is responsive to the read data to generate a display signal or a video signal suited for the kind of the display 10, which signal is applied to the display 10.

Figure 2:
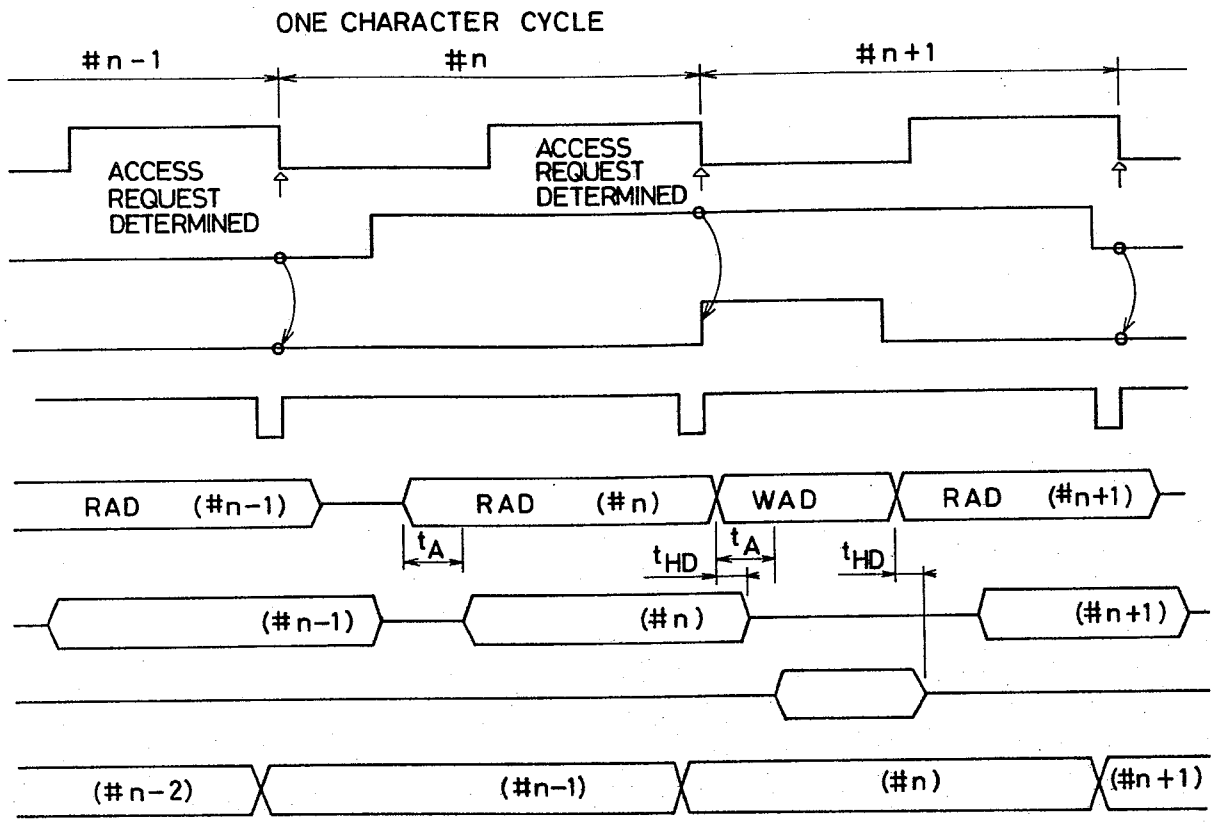
FIG. 2 is a time chart for explaining an operation of the FIG. 1 embodiment.

FIG. 2 is a time chart for explaining the operation of the FIG. 1 diagram. Referring to the figure, $t_A$ denotes the access time of the refresh memory 1 and $t_{HD}$ denotes the data holding time of the refresh memory 1.

Now referring to FIGS. 1 and 2, the operation of the FIG. 1 diagram will be described. The above described read control circuit 3 provides the character clock CLK which becomes the low level for a half period and becomes the high level for the remaining half period for each of the above described minimum read periods, which is applied to the access control circuit 5. The character clock CLK is applied to the latch enabling circuit 8. At the same time, the read control circuit 3 generates the read address data RAD in synchronism with the character clock CLK, which is applied to the multiplexer 2.

Now consider a case where the read address data RAD is in cycle (n−1), for example. In such a state, the access switch signal MPSE of the high level is not supplied to the multiplexer 2. Therefore, the multiplexer 2 provides the (n−1)-th read address data to the refresh memory 1. At the timing slightly before the end of one period of the character clock CLK, i.e. at the timing shortly before the character clock CLK falls to the low level, the latch enabling circuit 8 provides the latch enabling pulse LEP, which is applied to the latch circuit 7. Accordingly, the latch circuit 7 latches the data RD read from the refresh memory 1 during one period of the character clock CLK. At that time, the video signal generating circuit 9 serves to convert the data LD latched by the latch circuit 7 to a display signal or a video signal in a format required by the display 10. The display signal or the video signal is supplied to the display 10 in synchronism with the display timing signals DT1 and DT2. As a result, the display 10 displays the above described minimum unit.

At the timing when the character clock CLK falls to the low level, the access control circuit 5 determines whether the access request signal RMSE is the high level and, if the same is the low level, maintains the access switch signal MPSE of the output therefrom as the low level. Therefore, at the n-th timing of the character clock CLK, the display data one period before as latched by the latch circuit 7 is supplied to the video signal generating circuit 9 and thus to the display 10. In the n-th period of the character clock CLK the read control circuit 3 provides the read address data RAD designating the n-th storing region of the refresh memory 1, which is applied to the multiplexer 2. The refresh memory 1 reads the n-th display data with a delay of the access time $t_A$, which is applied to the latch circuit 7. Since the latch circuit 7 is not supplied with the latch enabling pulse LEP at that time, the n-th display data is not latched.

In the case where data need be renewed at the timing of the n-th character clock CLK, the display data renewal control circuit 4 provides the access request signal RMSE of the high level. The display data renewal control circuit 4 provides the write address data WAD to the multiplexer 2 and the write data WD to the line buffer 6 simultaneously with withdrawal of the access request signal RMSE. Accordingly, the line buffer 6 temporarily stores the write data WD. At that time, the access control circuit 5 does not provide the access switch signal MPSE during a time period when the access request signal RMSE is the high level for the purpose of determining whether the access request is available at the timing when the character clock CLK falls to the low level. Accordingly, during the n-th period of character clock CLK the refresh memory 1 continues to read the n-th display data. At the timing immediately before the fall of the character clock CLK, the latch enabling circuit 8 provides the latch enabling pulse LEP, which is applied to the latch circuit 7. As a result, the n-th display data is latched by the latch circuit 7 and is displayed by the display 10.

Thereafter when the character clock CLK turns to the low level, the access control circuit 5 provides the access switch signal MPSE of the high level during a predetermined time period required for writing the write data of a given unit such as one character or several characters. The above described access switch signal MPSE is applied to the multiplexer 2 and the line buffer 6. Therefore, the multiplexer 2 interrupts withdrawal of the read address data RAD and provides the write address data WAD to the refresh memory 1. Therefore, the refresh memory 1 terminates withdrawal of the n-th display data with delay of a data holding time $t_{HD}$. With a further delay of the access time $t_A$, the line buffer 6 reads the write data WD, which is applied to the refresh memory 1. As a result, the refresh memory 1 stores the write data WD in the address designated by the write address data WAD. A predetermined time period after the access switch signal MPSE, again the multiplexer 2 provides to the refresh memory 1 the read address data RAD for designating the (n+1)-th address obtained from the read control circuit 3.

Thus the data writing is performed. However, even during the data write period the latch circuit 7 latches the data read during the previous one period of the character clock CLK and therefore a flickering phenomenon and disturbance of display can be prevented. Furthermore, writing of the renewal data in the refresh memory 1 is performed in a predetermined time period shorter than one cycle of the character clock CLK. Therefore, the restriction is eliminated that conventionally renewal of the memory had to be performed after all the storage capacity is read out. Therefore, according to the embodiment shown, renewal of data can be performed not during the blanking period but at any timing.

Figure 3:
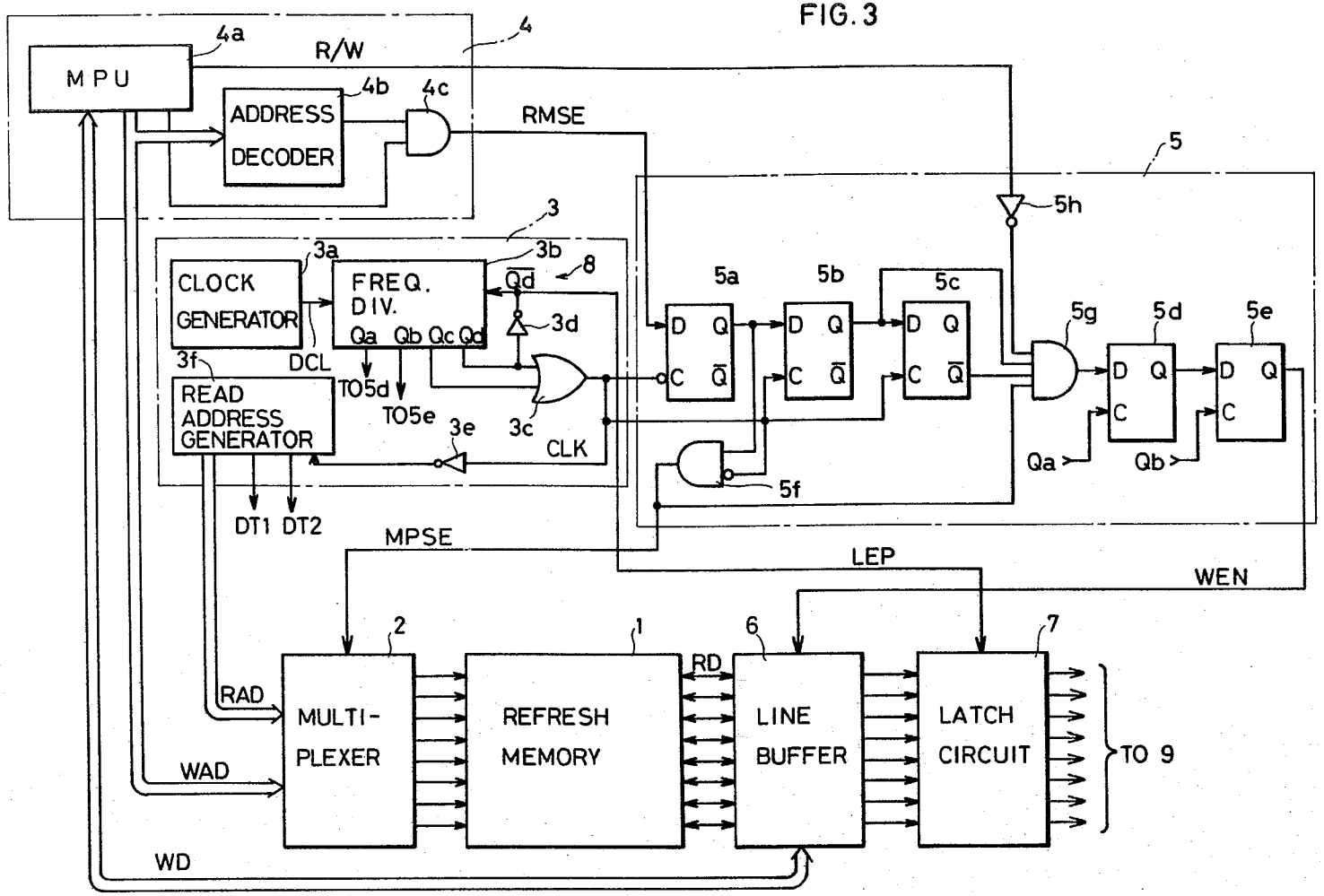
FIGS. 3 and 4 are block diagrams showing in some detail the FIG. 1 embodiment.
Figure 4:
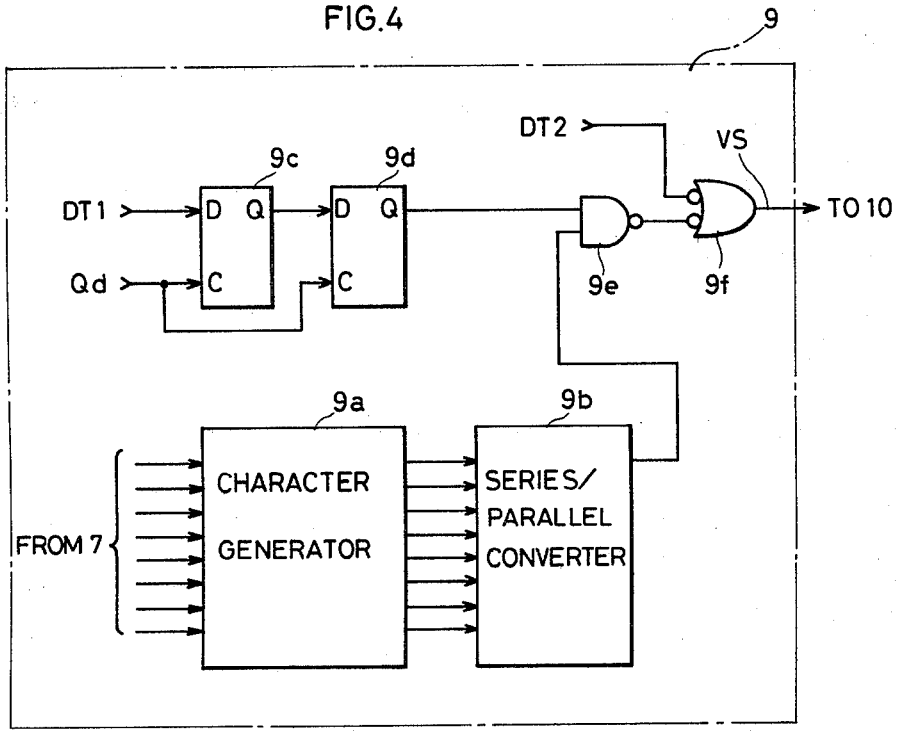
Figure 5A:
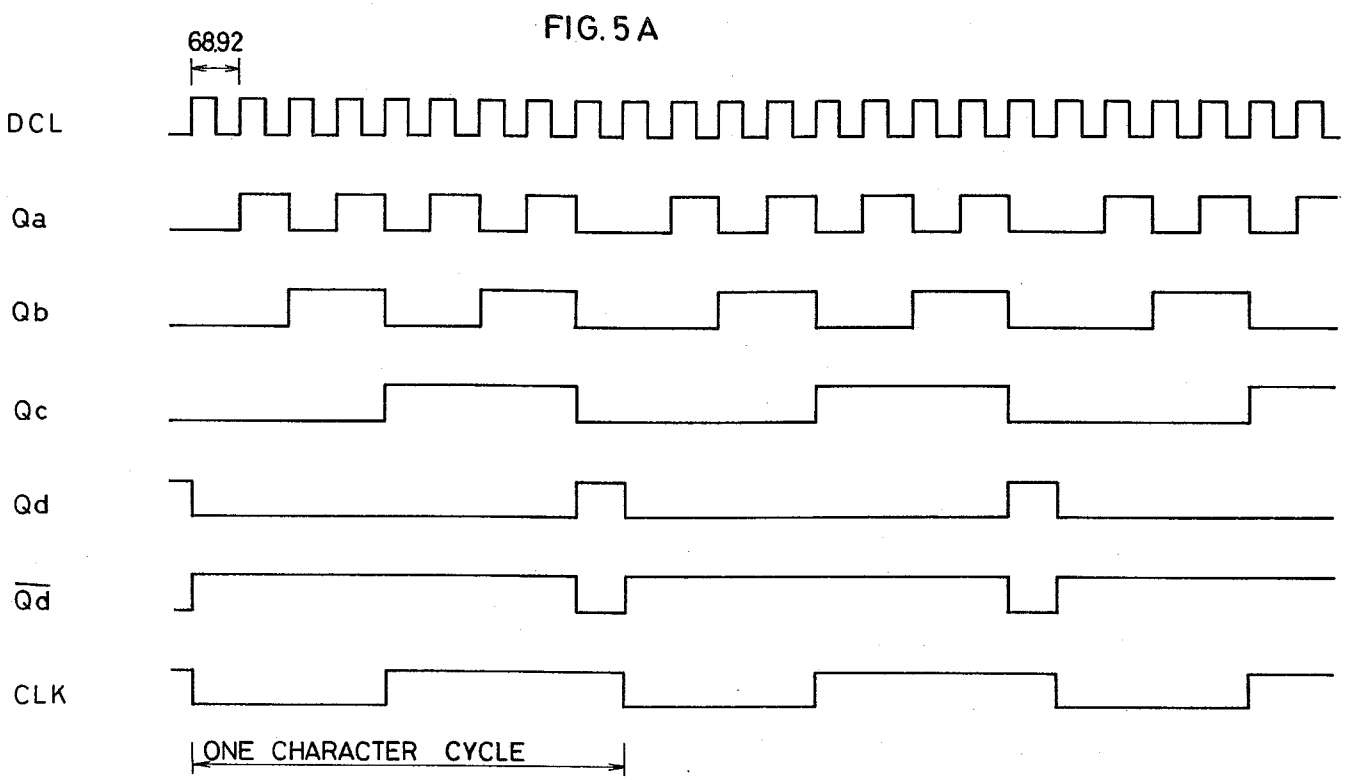
FIGS. 5A and 5B are time charts for explaining the operation of the diagrams shown in FIGS. 3 and 4.
Figure 5B:
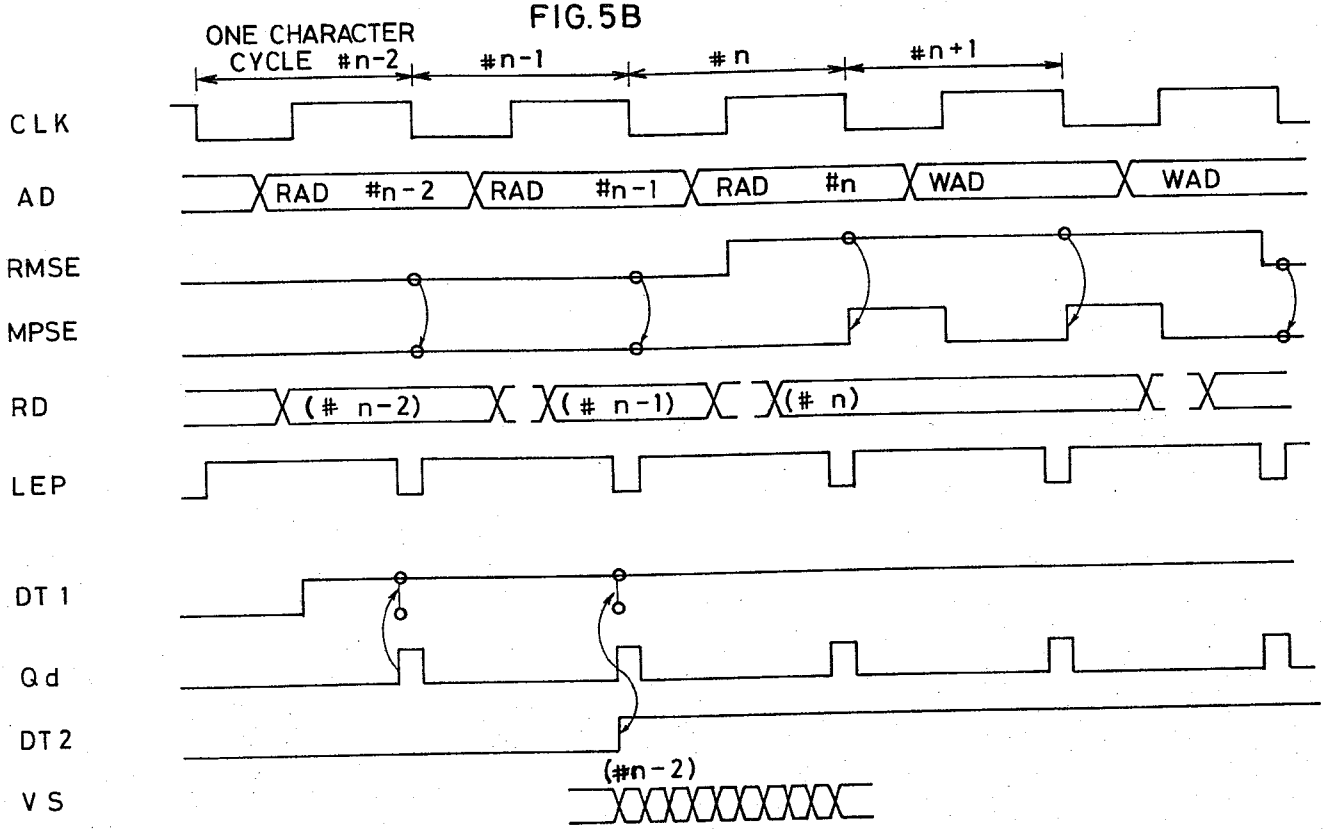

Now a more detailed diagram of the FIG. 1 embodiment will be described. FIGS. 3 and 4 are schematic diagrams of various portions of the FIG. 1 diagram. Particularly, FIG. 3 shows in detail the read control circuit 3, the display data renewal control circuit 4, the access control circuit 5 and the latch enabling circuit 8. FIG. 4 shows in detail the video signal generating circuit 9. FIGS. 5A and 5B are timing charts for facilitating an understanding of the description concerning the operation of the embodiment specifically shown in FIGS. 3 and 4.

Now referring to FIGS. 3 to 5B, the detailed structure and the operation thereof of the respective circuits will be described.

The above described read control circuit 3 comprises a clock generator 3*a*, a frequency divider 3*b*, an OR gate 3*c*, inverters 3*d* and 3*e* and an address data generating circuit 3*f*. The clock generator 3*a* generates a dot clock DCL of a predetermined cycle, which is applied to the frequency divider 3*b*. In the case where the display 10 is a CRT display, the dot clock DCL is selected to be the frequency corresponding to the time period in which an electron beam of the CRT display moves in the horizontal direction by one dot. The frequency divider 3*b* provides a pulse Qa obtained by frequency dividing the dot clock DCL by $\frac{1}{2}$, a pulse Qb obtained by frequency dividing the dot clock DCL by $\frac{1}{4}$, a pulse Qc obtained by frequency dividing the dot clock DCL by $\frac{1}{8}$ and a pulse Qd. The pulse Qd is outputted from an output terminal for providing a pulse obtained by frequency dividing the dot clock DCL by 1/16 and is applied through an inverter 3*d* to a reset input of the frequency divider 3*b*. Thus the frequency divider 3*b* generates the pulses Qa, Qb, Qc and Qd as shown in FIGS. 5A. The pulses Qc and Qd are applied to the OR gate 3*c*. The OR gate 3*c* provides a pulse obtained as a logical sum of the pulses Qc and Qd as a character clock CLK. More specifically, the one cycle of the character clock CLK contains nine dot clocks DCL, as is clear from FIG. 5A. The reason is that assuming that the dot number in one character in the horizontal direction is eight dots and the space between the adjacent characters is one dot, nine dots are required for displaying one character. Meanwhile, the output pulse $\overline{Qd}$ of the inverter 3*d* is applied to the latch circuit 7 as the latch enabling pulse LEP. More specifically, in the embodiment shown the frequency divider 3*b* and the inverter 3*d* function as a portion of the read control circuit 3 and also serve simultaneously as the latch enabling circuit 8.

The above described character clock CLK is inverted by the inverter 3*e* and is applied to the read address generating circuit 3*f*. The read address generating circuit 3*f* may be implemented by an integrated circuit, model HD 46505, manufactured by Hitachi Ltd., Japan. The read address generating circuit 3*f* generates the read address data RAD with a delay of a minor time period from the fall of the character clock CLK, i.e. from the raise of the output of the inverter 3*e*, which is applied to the multiplexer 2, and also provides the display timing signals DT1 and DT2. The display timing signal DT1 remains the high level, insofar as the read address generating circuit 3*f* generates the address data. The read timing signal DT1 is applied to a D-type flip-flop 9*c*, to be described subsequently. The display timing signal DT2 becomes the high level with a delay of a time period when two pulses Qd are obtained after the signal DT1 is obtained. The reason is that there is a delay of two character cycles after the refresh memory 1 is accessed until the read data of the refresh memory 1 is applied to the CRT display 10 and such delay time is to be compensated.

The above described display data renewal control circuit 4 comprises a microprocessor 4*a*, an address decoder 4*b* and an AND gate 4*c*. The microprocessor 4*a* may be implemented by an integrated circuit, model MC6802, manufactured by Motorola Incorporated, U.S.A. The microprocessor 4*a* brings the read/write signal R/W to the high level on the occasion of the read mode when the stored data of the refresh memory 1 is to be read. On the occasion of the read mode, the microprocessor 4*a* does not provide either the write address data WAD or the write data WD. Therefore, the address decoder 4*b* does not provide the high level and the output of the AND gate 4*c*, i.e. the access request signal RMSE remains the low level.

The access control circuit 5 comprises D-type flip-flops 5*a* to 5*e*, AND gates 5*g* and 5*f* and an inverter 5*h*. Even if the character clock CLK is applied in the read mode, the access request signal RMSE remains the low level, and therefore, the output Q of the D-type flip-flop 5*a* remains the low level. Therefore, the AND gate 5*f* provides the output of the low level during the period of the read mode. More specifically, the access switch signal MPSE of the high level is not provided. In such a case, as described previously in conjunction with FIG. 1, the multiplexer 2 provides the refresh memory 1 with the read address data RAD. The data RD read from the refresh memory 1 as addressed by the read address data RAD is applied through the line buffer 6 to the latch circuit 7. The latch circuit 7 latches the data RD read from the refresh memory 1 each time the latch enabling pulse LEP is obtained from the inverter 3*d*. The data LD latched by the latch circuit 7 is applied to the video signal generating circuit 9.

The video signal generating circuit 9 comprises a character generator 9*a*, a parallel/serial converter 9*b*, D-type flip-flops 9*c* and 9*d*, a NAND gate 9*e* and an OR gate 9*f*. The character generator 9*a* comprises a memory, i.e. a character read only memory for storing the data of a plurality of kinds of character patterns. The character generator 9*a* reads in a bit parallel fashion the data of the character pattern of the kind corresponding to the data LD obtained from the latch circuit 7, which data is applied to the parallel/serial converter 9*b*. The parallel/serial converter 9*b* provides in a bit serial fashion the data of the character pattern, which is applied to the NAND gate 9*e*. On the other hand, the data input terminal (D) of the D-type flip-flop 9*c* is supplied with the display timing signal DT1. The output Q of the D-type flip-flop 9*c* is applied to the data input terminal (D) of the D-type flip-flop Qd. The clock input terminal (C) of the D-type flip-flops 9*c* and 9*d* are supplied with the pulse Qd. Accordingly, the output Q of the D-type flip-flop 9*d* provides the high level output with a delay by two character clocks after the display timing signal DT1 is applied, which is applied to the AND gate 9*e*. More specifically, the AND gate 9*e* provides the display data converted by the parallel/serial converter 9*b* through the OR gate 9*f* to the CRT display 10 as a video signal VS from the timing with a delay from the display timing signal DT1 by two character clocks. Meanwhile, in the case where a cursor position of the character being displayed by the CRT display 10 need be informed to a viewer, the display timing signal DT2 is supplied through the OR gate 9*f* to the CRT display 10.

On the other hand, in the write mode the microprocessor 4*a* brings the read/write signal R/W to the low level. The R/W signal is inverted to the high level by the inverter 5*h* and the inverted output is applied to the AND gate 5*g*. The microprocessor 4*a* provides the write address data WAD to the address decoder 4*b* and at the same time provides the write data WD to the line buffer 6. The address decoder 4*b* is responsive to the supply of the write address data WAD to provide the high level output to the AND gate 4*c*. The AND gate 4*c* provides the access request signal RMSE of the high level when the reference clock signal of the microprocessor 4*a* is obtained, and the signal RMSE is applied to the data input terminal (D) of the D-type flip-flop 5*a*. The D-type flip-flop 5*a* stores the access request signal RMSE being applied to the data input (D) at the fall of the character clock CLK, thereby to provide the output Q. Therefore, the AND gate 5*f* provides the access switch signal MPSE of the high level at the following cycle of the character clock CLK, which is applied to the multiplexer 2. Accordingly, the multiplexer 2 selects the write mode and provides the write address data WAD to the refresh memory 1. The AND gate 5*g* provides the high level output with a delay of two cycles of the character clock CLK after the access request signal RMSE is obtained, which is applied to the data input terminal (D) of the D-type flip-flop 5*d*. Therefore, the D-type flip-flops 5*d* and 5*e* are responsive to receipt of the pulses Qa and Qb to provide from the respective outputs Q in sequence the high level outputs. The output Q of the D-type flip-flop 5*e* is applied to the line buffer 6 as the write enabling signal WEN. As a result, the write data WD being applied to the line buffer 6 is applied and stored in the refresh memory 1. At that time the latch circuit 7 continues to provide the data as latched with the character clock CLK one cycle before.

Meanwhile, in the embodiment shown the microprocessor 4*a* selects the write mode at any timing either during the horizontal scanning period of the CRT display 10 or the blanking signal period. Therefore, reading of the data from or writing the data in the refresh memory 1 is not limited to the time chart shown in FIG. 5B.

Meanwhile, in the above described FIG. 1 embodiment the description was made of the case where the data to be displayed by the display 10 is changeable over the full range of the screen of the display 10 but alternatively the desired data can be displayed in a fixed manner in a certain display region. Therefore, in the following an embodiment will be described in which the fixed data is to be displayed in a portion of the screen of the display 10.

Figure 6:
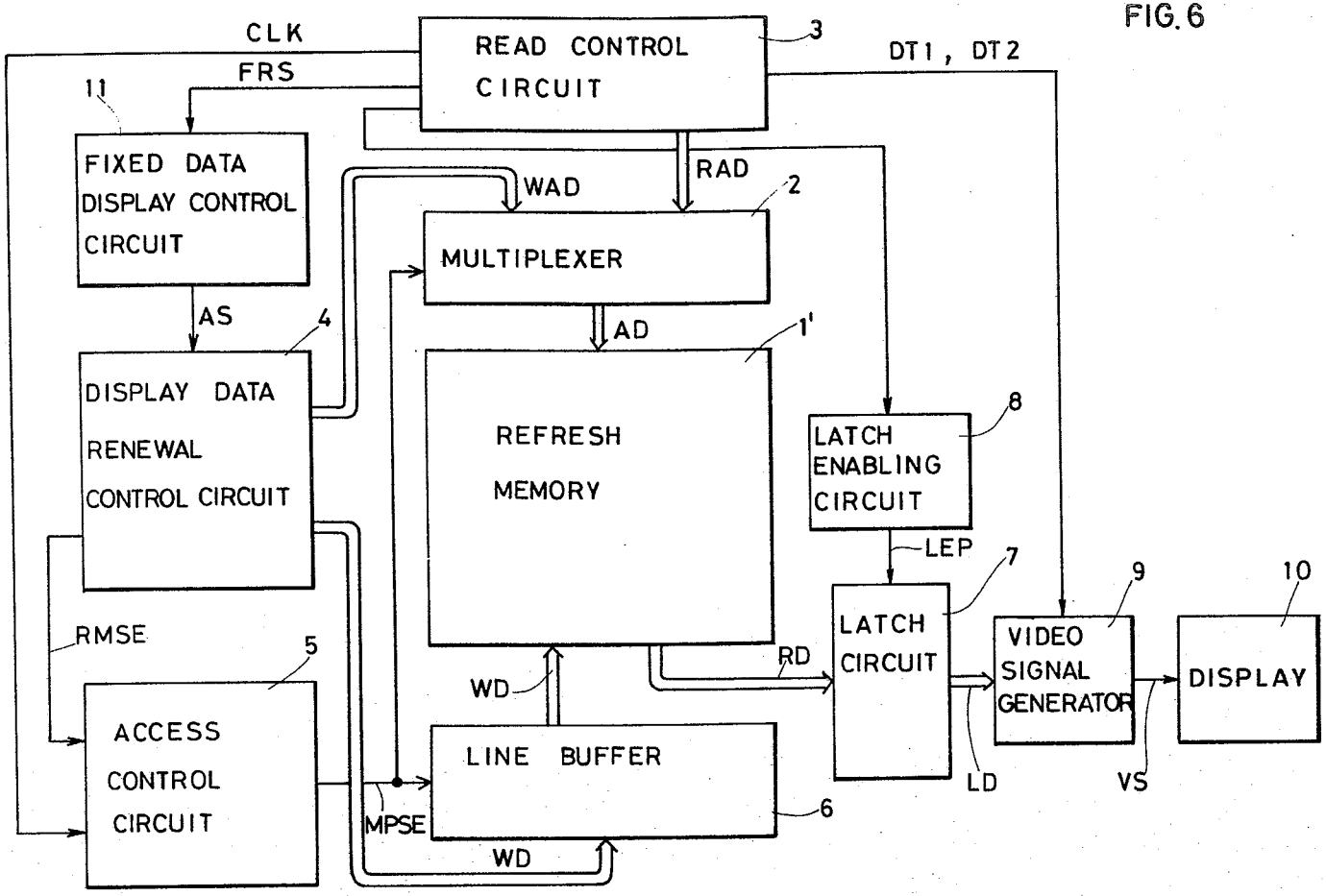
FIG. 6 is a block diagram of another embodiment of the present invention.

FIG. 6 is a block diagram of a display control apparatus in accordance with another embodiment of the present invention. The refresh memory 1' comprises a storage capacity of the number of addresses capable of storing the data of a frame larger than one picture frame to be displayed by the display 10. The detail of the refresh memory 1' will be described subsequently in conjunction with FIG. 7. The refresh memory 1' is supplied with the address data AD from the multiplexer 2. The multiplexer 2 is supplied with the read address data RAD from the read control circuit 3 and is also supplied with the write address data WAD from the display data renewal control circuit 4. The read control circuit 3 generates a character clock CLK necessary for reading the display data of the minimum unit and also generates the read address data RAD in synchronism with the character clock CLK and further generates a fixed data read enabling signal FRS and further provides a synchronizing signal in synchronism with the reading of refresh memory 1', which is applied to the display 10. The synchronizing signal comprises a first display timing signal DT1 and a second display timing signal DT2 (shown in FIG. 5B) for designating the display timing of the display 10.

The above described fixed data read enabling signal FRS is supplied to the fixed data display control circuit 11. The fixed data display control circuit 11 provides the address modify signal AS for enabling the reading of the fixed data, which is applied to the display data renewal control circuit 4. The display data renewal control circuit 4 comprises a microprocessor, for example, including a circuit for performing an arithmetic operation and a memory for storing the data covering a number of picture frames each being displayed by the display. Meanwhile, in the case where the display data is obtained externally, the memory is not necessary. The display data renewal control circuit 4 generates the read address data RAD of the fixed data when the address modify signal AS is applied. The display data renewal control circuit 4 generates the access request signal RMSE of the high level, the write data WD and the write address data WAD on the occasion the address modify signal is not present and the data of the refresh memory 1' need be renewed. More specifically, the display data renewal control circuit 4 has two functions of renewing the changeable data and reading the fixed data.

The above described character clock CLK and the access request signal RMSE are applied to the access control circuit 5. The access control circuit 5 determines whether the access request signal RMSE is received at each cycle of the character clock CLK, say at each fall of the character clock CLK and provides the access switch signal MPSE when the access request signal RMSE is available. The access switch signal MPSE is applied to the multiplexer 2 as a signal for enabling selection to the write mode and is also applied to the line buffer 6. The line buffer 6 comprises a storage capacity corresponding to the number of picture elements of one line in the horizonal direction in the display 10 and stores the data of one line as the write data WD of one unit and the same is applied to the refresh memory 1'. The read data RD from the refresh memory 1' is applied to the latch circuit 7. The latch circuit 7 is supplied with the latch enabling pulse LEP from the latch enabling circuit 8. The latch enabling circuit 8 is adapted to generate the latch enabling pulse LEP shortly before the start of the next cycle of the character clock at each cycle of the character clock CLK.

Figure 7:
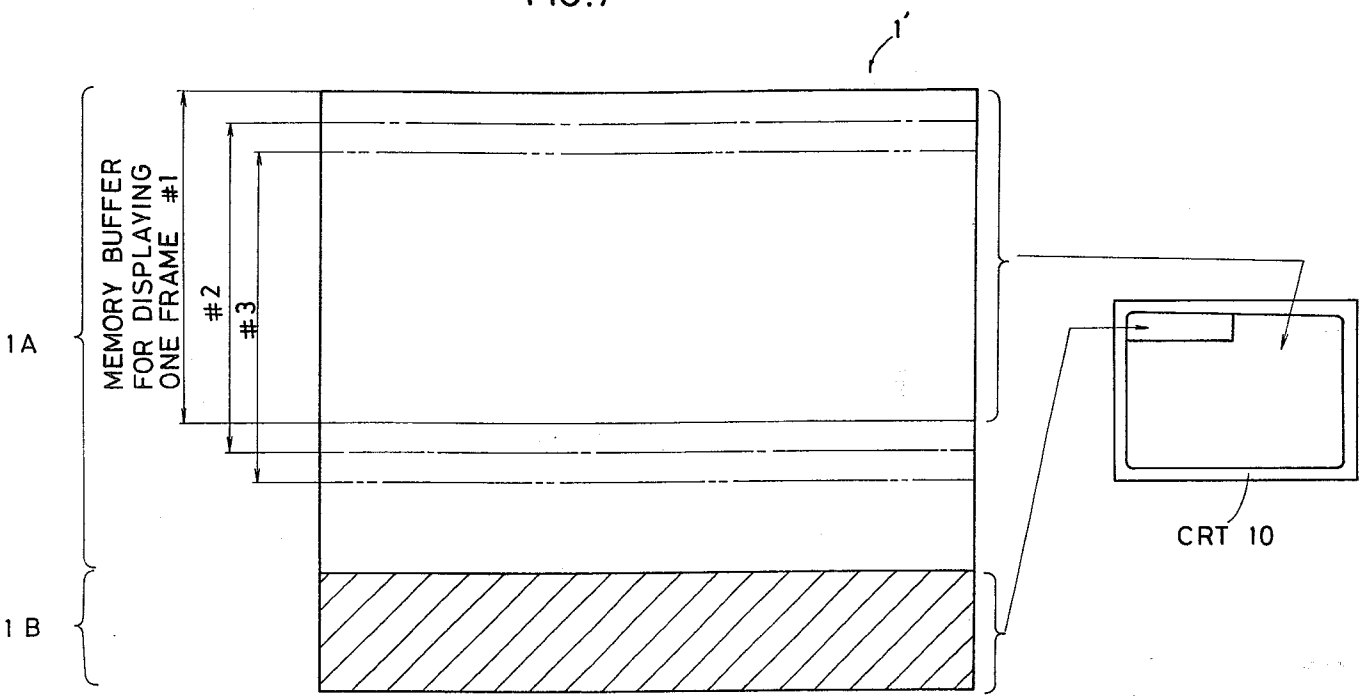
FIG. 7 is a diagram showing a relation between the storing region of the refresh memory and the display in the FIG. 6 embodiment.

FIG. 7 is a view showing a relation between the storing region in the above described refresh memory 1' and the display 10 (for example a CRT display). The refresh memory 1' is divided into a changeable data storing region 1A and a fixed data storing region 1B. The changeable data storing region 1A comprises a storage capacity larger than a storage capacity required for storing the display data of one picture frame of the display 10 and is adapted such that the address of the storing region from where the data is read out is shifted by a predetermined number at each time the data of one picture frame is read out. By repeating this the changeable data VD stored in all the storing regions of the changeable data storing region 1A is read out at each given cycle. The fixed data storing region 1B is adapted to store the fixed data FD as described previously, i.e. the data to be displayed in a fixed format, and the content thereof is not read out by the addressing by the above described read control circuit 3. In other words, the fixed data storing region 1B is a storing region wherein the data can not be read by the read control circuit 3.

Figure 8:
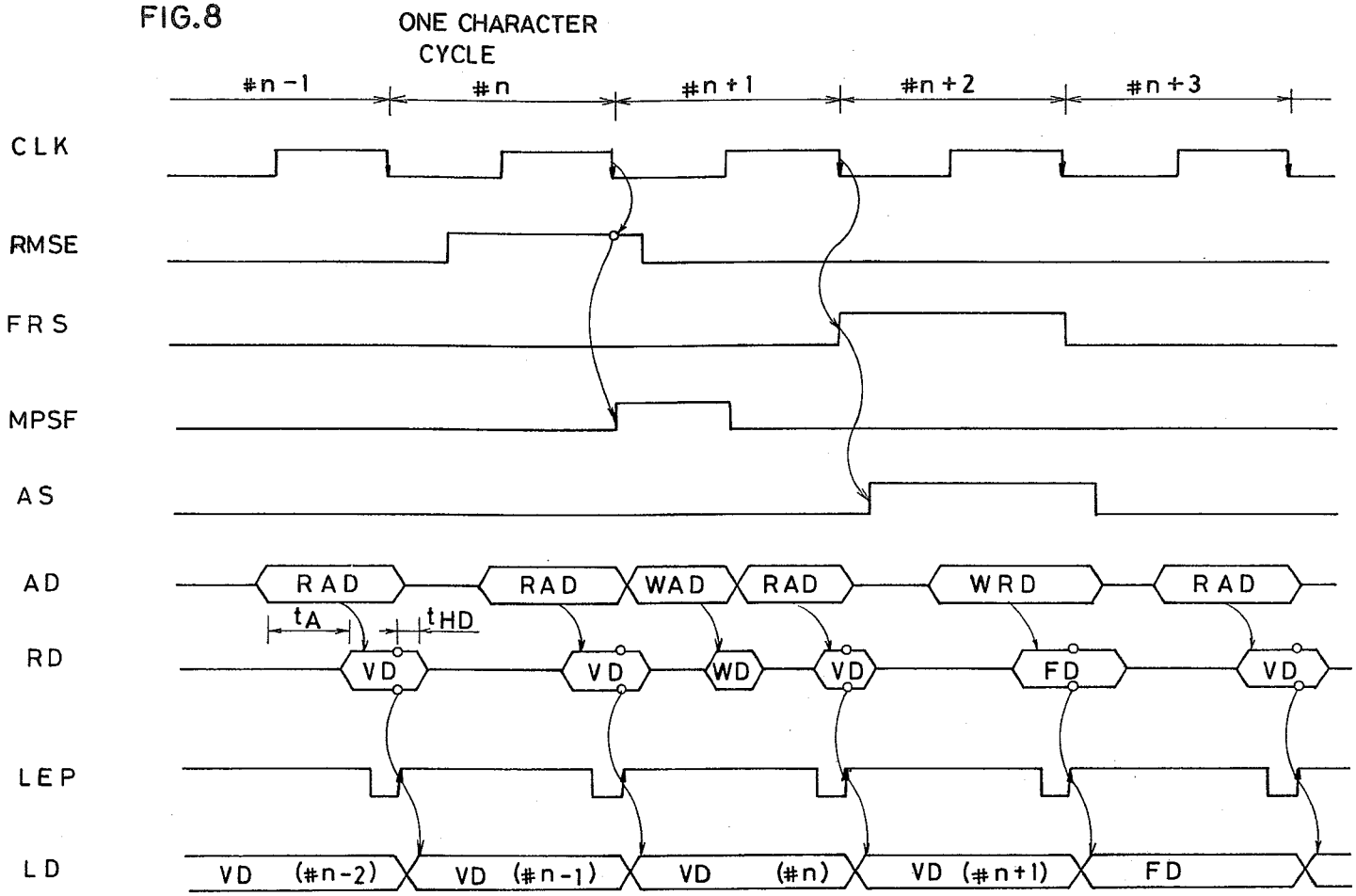
FIG. 8 is a time chart for explaining the operation of the FIG. 6 embodiment.

FIG. 8 is a time chart for explaining the operation of the FIG. 6 diagram.

According to the embodiment shown, the operation for displaying the data in the changeable data storing region 1A of the refresh memory 1' with the display 10 by reading the same in the read mode and the operation for writing the changeable data into the region 1A in the write mode are the same as those described in conjunction with FIG. 1. Therefore, in the following only an operation in the case where the fixed data is displayed will be described with reference to FIGS. 6 to 8. For example, consider a case where the timing when the fixed data is to be displayed is the n+2-th character clock. At the timing of the n+2-th character clock the read control circuit 3 provides the fixed data read enabling signal FRS at the fall of the n+1-th character clock CLK, which is applied to the fixed data display control circuit 11. The fixed data display control circuit 11 provides the address modify signal AS, which is applied to the display data renewal control circuit 4. Accordingly, the display data renewal control circuit 4 provides the access selecting signal ASS with a slight time delay to the multiplexer 2 and also provides the read address data RAD of the fixed data to the multiplexer 2. Therefore, the multiplexer 2 provides the read address data RAD of the fixed data to the refresh memory 1'. At the timing of the n+2-th character clock CLK when the latch enabling pulse LEP is obtained. The latch circuit 7 latches the fixed data read from the refresh memory 1'. Accordingly, during the period of the n+3-th character clock CLK the fixed data is read from the latch circuit 7 and is applied to the video signal generating circuit 9 and thus to the display 10.

Meanwhile, it is needless to say that the timing when the fixed data is to be read out is the timing when the display position of the fixed data on the screen of the display 10 is designated. The fixed data read enabling signal FRS is cyclically obtained at the timing corresponding to the position on the screen where the fixed data is to be displayed. In the case where the changeable data is to be displayed at the timing of the following n+3-th character clock CLK, the above described fixed data read enabling signal FRS comes not to be obtained. Therefore, as in the case of the previously described n−1-th timing in conjunction with FIG. 1, the changeable data is read out and is displayed.

Thus display of the fixed data is performed at every predetermined cycle. Therefore, a flickering phenomenon of display which might occur due to irregularity of the display timing of the fixed data can be prevented and hence the write processing time of the changeable data can be drastically shortened.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A display control apparatus for controlling operation of a display including a relatively large number of picture elements arranged both in vertical and horizontal directions and displaying a minimum unit of display data having a relatively small number of picture elements both in the vertical and horizontal directions, said display control apparatus comprising:

display data storage means for storing a plurality of said minimum units of display data to be displayed by said display, means for generating read address data for designating addresses of data to be read from the data stored in said display data storage means, means for generating write address data for designating addresses for writing in said display data storage means the display data of said minimum units of display data, means for periodically generating a signal representing a minimum unit period, said minimum unit period being representative of a time required for one of said minimum units of display data to be displayed by said display, means responsive to said minimum unit period representing signal for generating a latch enabling signal in a latch period within said minimum unit period and having a predetermined phase relative to said minimum unit period representing signal, write data supply means for supplying said minimum units of display data, writing means responsive to said write data for writing the same into said display data storage means as addressed by said write address data in a writing period contained within said minimum unit period but excluding the latch period such that said writing period and said latch period do not overlap, and latch means responsive to said latch enabling signal for latching said minimum units of display data read from said display data storage means as addressed by said read address data and for supplying said display with said minimum units of display data.

2. A display control apparatus in accordance with claim 1, wherein said writing means comprises means for generating a write enabling signal in said writing period when said latch enabling signal is obtained from said latch enabling signal generating means, and means responsive to said write enabling signal for selecting said write address data to apply the same to said display data storage means and responsive to the absence of said write enabling signal for selecting said read address data to apply the same to said display data storage means.

3. A display control apparatus in accordance with claim 1, wherein said display data storage means comprises refresh memory means.

4. A display control apparatus in accordance with claim 1, which further comprises buffer memory means for temporarily storing said write data supplied from said write data supply means for supplying said write data to said display data storage means.

5. A display control apparatus in accordance with claim 1, wherein said display comprises a cathode ray tube display, and said display data of each said minimum unit comprises data of one line of one character in the horizontal direction to be displayed with said cathode ray tube.

6. A display control apparatus in accordance with claim 5, which further comprises video signal generating means responsive to said display data stored in said latch means for generating a video signal for displaying said display data with said cathode ray tube display.

7. A display control apparatus in accordance with claim 1, wherein said display data storage means includes a first storing region for storing fixed data and a second storing region for storing changeable data, and said read address data generating means comprises means for generating a fixed data read enabling signal having a predetermined period, first address data generating means responsive to said fixed data read enabling signal for generating said address data of said first storing region, and second address data generating means for generating read address data for reading said second storing region during a period in the absence of said fixed data read enabling signal.

8. A display control apparatus in accordance with claim 7, wherein said write address data generating means comprises third address data generating means for generating write address data, fourth address data generating means for generating read address data of said first storing region, said first address data generating means and said fourth address data generating means comprise common means.

9. A display apparatus comprising:

a display;

memory means for storing a plurality of minimum units of display data, each of said minimum units containing a small number of picture elements to be displayed by said display;

latch means connected between said memory means and said display for sequentially latching minimum units of display elements as they are read from said memory means for display by said display;

means for generating a clock signal having a period equivalent to the time required for the display of one of said minimum units;

read means for reading said minimum units from said memory means to said latch means;

write means for writing said minimum units into said memory means;

access control means for granting access of either said read means or said write means to said memory means;

access request means for generating an access request signal to said access control means, said access request signal having a first state for requesting access of one of said read means and said write means to said memory means and having a second state for requesting access of the other of said read means and said write means to said memory means, said access control circuit being responsive to said first state for immediately granting said one of read means and said write means access to said memory means, and being responsive to said second state for granting said other of said read means and said write means access to said memory means in a given clock period only if said second state occurs prior to said first state, otherwise, granting said other of said read means and said write means access to said memory means in the next succeeding clock period.

10. A display control apparatus as set forth in claim 9, including means for generating a latch enabling signal to said latch means for causing said latch means to latch said data read from said memory means, and wherein said generating means generates said latch enabling signal at a predetermined phase relative to said clock signal.

* * * * *